US008050792B2

(12) United States Patent
Bergsten

(10) Patent No.: US 8,050,792 B2
(45) Date of Patent: Nov. 1, 2011

(54) METHOD AND DEVICE FOR OPTIMIZATION OF FLATNESS CONTROL IN THE ROLLING OF A STRIP

(75) Inventor: Pontus Bergsten, Örebro (SE)

(73) Assignee: ABB AB, Västerås (SE)

( * ) Notice: Subject to any disclaimer, the term of this patent is extended or adjusted under 35 U.S.C. 154(b) by 283 days.

(21) Appl. No.: 11/921,868

(22) PCT Filed: May 8, 2006

(86) PCT No.: PCT/SE2006/000674

§ 371 (c)(1),
(2), (4) Date: Jun. 15, 2010

(87) PCT Pub. No.: WO2006/132585

PCT Pub. Date: Dec. 14, 2006

(65) Prior Publication Data

US 2010/0249973 A1 Sep. 30, 2010

(30) Foreign Application Priority Data

Jun. 8, 2005 (SE) ..... 0501406

(51) Int. Cl.

| | |
|---|---|
| ***G06F 19/00*** | (2006.01) |
| ***B21B 37/28*** | (2006.01) |
| ***B21B 37/00*** | (2006.01) |
| ***B21B 37/58*** | (2006.01) |

(52) U.S. Cl. ..... 700/154; 700/155; 72/9.1; 72/9.2; 72/11.7; 72/11.8

(58) Field of Classification Search ..... 700/145, 700/148, 150, 154, 155; 72/7.6, 8.6, 8.7, 72/9.1, 10.6, 9.2, 9.4, 11.6–11.8
See application file for complete search history.

(56) References Cited

U.S. PATENT DOCUMENTS 3,709,010 A * 1/1973 Tatsumi ..... 72/10.6
(Continued)

FOREIGN PATENT DOCUMENTS

DE 10211623 A1 10/2003
(Continued)

OTHER PUBLICATIONS

Bulut et al., "Co-ordinated control of profile and shape in hot strip finishing mills with nonlinear dynamics", IEEE Proceedings on Control Theory and Applications, vol. 149, Issue: 5, Publication Year: 2002, pp. 471-480.*

(Continued)

*Primary Examiner* — Crystal J Barnes-Bullock
(74) *Attorney, Agent, or Firm* — Venable LLP; Eric J. Franklin

(57) ABSTRACT

A method and a device for optimization of flatness control in the rolling of a strip using any number of mill stands and actuators. A mill model is used represented by a mill matrix that includes information of the flatness effect of each actuator. Each actuator's flatness effect is translated into a coordinate system having a dimension less than or equal to the number of actuators used. The actual flatness values are monitoring/sampling across the strip. A vector of the flatness error/deviation is computed as the difference between the monitored/sampled strip flatness and a reference flatness vector. The flatness error is converted into a smaller parameterized flatness error vector. A dynamic controller is used to calculate optimized actuator set-points in order to minimize the parameterized flatness error, thereby achieving the desired strip flatness. Also a system for optimization of flatness control in rolling a strip.

19 Claims, 3 Drawing Sheets

U.S. PATENT DOCUMENTS

| | | | | | |
|---|---|---|---|---|---|
| 4,261,190 | A | * | 4/1981 | Fapiano | 72/8.7 |
| 5,233,852 | A | * | 8/1993 | Starke | 72/7.6 |
| 5,535,129 | A | * | 7/1996 | Keijser | 700/148 |
| 5,680,784 | A | * | 10/1997 | Tateno et al. | 72/8.7 |
| 5,809,817 | A | * | 9/1998 | Ginzburg | 72/8.6 |
| 6,022,591 | A | * | 2/2000 | Ueberschar | 427/356 |
| 6,158,260 | A | * | 12/2000 | Ginzburg | 72/9.1 |
| 6,314,776 | B1 | | 11/2001 | Puda | |
| 6,721,620 | B2 | | 4/2004 | Jelali et al. | |
| 7,031,797 | B2 | | 4/2006 | Reinschke et al. | |
| 7,577,489 | B2 | * | 8/2009 | Fodor et al. | 700/154 |
| 7,748,247 | B2 | * | 7/2010 | Martin et al. | 72/11.7 |
| 7,823,428 | B1 | * | 11/2010 | Malik et al. | 72/7.1 |
| 7,937,165 | B2 | * | 5/2011 | Moden et al. | 700/39 |
| 2007/0006625 | A1 | | 1/2007 | Reinschke | |

FOREIGN PATENT DOCUMENTS

| | | | | |
|---|---|---|---|---|
| DE | 10346274 | A1 | | 4/2005 |
| EP | 1110635 | A1 | | 6/2001 |
| JP | 03266007 | A | * | 11/1991 |
| JP | 06071319 | A | * | 3/1994 |
| JP | 11005110 | A | * | 1/1999 |
| WO | WO-2005/064270 | A1 | | 7/2005 |

OTHER PUBLICATIONS

Stephen R. Duncan et al; The Analysis and Design of Spatial Control Systems in Strip Metal Rolling; IEEE Transactions on Control Systems Technology, vol. 6, No. 2, Mar. 1998; pp. 220-232.

Mohieddine Jelali et al.; Advanced control strategies for rolling mills; METEC Congress 03; 3rd European Rolling Conference 2003; pp. 54-56.

Andreas Wolff et al; State of the Art and Future Trends in Metal Processing Control; In proceedings of the 3d European Rolling Conference; Jun. 16-18, 2003; pp. 393-402.

John V. Ringwood; Shape Control Systems for Sendzimir Steel Mills; IEEE Transactions on Control Systems Technology, vol, 8. No. 1; Jan. 2000; pp. 70-86.

M. J. Grimble; The Design of Strip Shape Control Systems for Sendzimir Mills; IEEE Transactions on Automatic Control; vol. AC-27, No. 3, Jun. 1982; pp. 656-666.

PCT/ISA/210—International Search Report—Oct. 2, 2006.

PCT/ISA/237—Written Opinion of the International Searching Authority—Oct. 2, 2006.

* cited by examiner e – flatness error
$e^p$ – parameterized flatness error
u – actuator setpoints
$y_a$ – actuator positions
$G_M$ – Mill matrix
G – Dynamic model matrix

METHOD AND DEVICE FOR OPTIMIZATION OF FLATNESS CONTROL IN THE ROLLING OF A STRIP

TECHNICAL FIELD

This invention relates to a method and a device for flatness control for rolled products using any number of mechanical or other actuators.

The flatness of a rolled product, a strip, is determined by the roll gap profile between the work rolls of the rolling mill and the thickness profile of the rolled strip. The strip flatness may then be influenced by manipulation of different control devices that affects the work roll gap profile. Such actuators may be mechanical devices such as work roll bending, intermediate roll bending, skewing or tilting devices, intermediate roll shifting, top crown actuators, or thermal devices such as work roll cooling/warming, etc.

The present invention relates to a method and a device for determining the set-points to the control devices (or actuators) by using a special control structure consisting of any linear multivariable controller together with a special parameterization of the deviation between the actual measured flatness and the desired target flatness, using the actuator properties, such as flatness effects and physical constraints, in the parameterization, in order to influence the strip flatness in an optimal way so that the desired strip flatness is obtained.

BACKGROUND OF THE INVENTION

The control devices or actuators in a rolling mill influence the flatness of the strip in different ways by affecting the roll gap profile of the work rolls.

A condition for high performance flatness control is to have continuous access to the actual flatness across the strip, that is, a flatness profile. With a known flatness profile, the rolling mill can be provided with a flatness control system that based on the measured flatness profile and a given target or reference flatness profile computes set points to the available control devices, achieving closed-loop flatness control, see FIG. 1. The flatness control comprises several executing devices which means that a relatively complex evaluation process have to be done in order to decide on the magnitude of the various actions by the control devices, which provide the best result.

A measurement device could be designed as a measuring roll of metal, with something like 16-64 measuring points located across the strip, which in most cases can be placed between the mill stand and the wind-up reel without the use of deflector rolls. Such a measuring roll is the "Stressometer" produced by ABB. The measurement takes place with the aid of force transducers, based on e.g. the magnetoelastic principle, and primarily provides the stress distribution of the strip along the measuring roll. If the stress is greater than the buckling stress for the material, the sheet buckles when the strip is left free with no influence by any tensile force. The stress distribution is a flatness profile for the strip across the rolling direction. Depending on the technology of the flatness measuring device and the current rolling speed, a new complete flatness profile measurement across the strip may be obtained as often as every 4:th ms (millisecond).

When rolling a strip, it is important to maintain the desired flatness profile at all times. Deviation from the desired flatness may result in costly strip breaks. The task of the flatness control system is thus to drive the actual flatness profile as close possible to the desired flatness profile, which put high requirements on such a system, in terms of calculation speed and accuracy.

PRIOR ART

The technique of flatness control is described in different publications such as:

M. J. Grimble, and J. Fotakis, "The Design of Strip Shape Control Systems for Sendzimir Mills", IEEE Transactions on Automatic Control, Vol. AC-27, No. 3, 1982.

J. V. Ringwood, "Shape Control Systems for Sendzimir Steel Mills", IEEE Transaction on Control Systems Technology, Vol. 8, No. 1, 2000.

A. Wolff, F. Gorgels, M. Jelali, R. Lathe, G. Mücke, U. Müller, and W. Ungerer, "State of the Art and Future Trends in Metal Processing Control", In Proceedings of the 3:rd European Rolling Conference, Düsseldorf, Germany, 16-18 Jun., 2003.

M. Jelalu, U. Müller, A. Wolff, and W. Ungerer, "Advanced Control Strategies for Rolling Mills", Metallurgical Plant and Technology International, No. 3, 2001.

S. R. Duncan, J. M. Allwood, and S. S. Garimella, "The Analysis and Design of Spatial Control Systems in Strip Metal Rolling", IEEE Transactions on Control Systems Technology, Vol. 6, No. 2, 1988.

In U.S. Pat. No. 6,721,620 a method for controlling flatness during rolling is also presented. The actual strip flatness profile is measured and parameterized using orthogonal polynomials. A flatness error deviation is generated using desired reference flatness profile parameterized by the same orthogonal polynomials. A controlled variable is then generated using a combined Model Predictive Control/Internal Mode Control scheme.

The present invention differs from this prior art by using a more classic control architecture that works the flatness error profile directly (which not expressed in terms of orthogonal polynomials). The current flatness deviation profile across the strip is parameterized using the Singular Value Decomposition (SVD) of an on-line mill model (the mill matrix), in such a way so that the actuator set-points produced by the following linear multivariable controller (provided with the parameterized error), does violates physical actuator constraints. The present invention allows control of any type of actuator.

Using traditional flatness control methods based direct inversion of the mill matrix for multi-actuator cold rolling mills often means following problems:

1. Direct inversion of the mill model (mill matrix) may cause the control system sensitive to be sensitive to model errors, which may cause instability or unnecessary movements of several actuators.
2. All actuators are used simultaneously. However due to non-perfect decoupling, the actuators are not independent controlled, which means that small movements of one actuator can cause large movements of other actuators and run these into limit conditions.
3. The above problems may result in that mill operators tend to use some actuators in manual mode.

The present invention parameterizes the flatness error profile using only the significant bending modes extracted using the SVD of the mill matrix, which results in a more stable and robust control behavior, and the above problems are resolved.

SUMMARY OF THE INVENTION

The invention relates to a method and a device that optimizes the actions of any number of control devices (or actuators) for the flatness control of a strip and comprises a method for robust evaluation of the control actions as well as an evaluation/calculation device, which constitutes an integral part of the control equipment.

Traditional flatness control methods for multi-actuator cold rolling mills often result in different problems. The system may for instance be sensitive for model errors causing instability or unnecessary movements of several actuators. Even if the actuators are used simultaneously the actuators are not independent which means that small movements of one actuator can cause large movements of other actuators and run these into limit conditions. After some time mill operators also tend to use some actuators in manual mode which is undesirable.

The object of the present invention is to resolve the problems mentioned above, and to create an improved, stable and robust flatness control system that at any given time uses the optimal combinations of the available actuators.

The objects of the present invention are achieved by a method for optimization of flatness control in the rolling of a strip using any number of actuators, comprising:

- using a mill model represented by a mill matrix that contains information of the flatness effect of each actuator,
- translating each actuator's flatness effect into a coordinate system, whose dimension is less or equal than the number of actuators used,
- monitoring/sampling the actual flatness values across the strip,
- computing a vector of the flatness error/deviation as the difference between the monitored/sampled strip flatness and a reference flatness vector,
- converting the flatness error into a smaller parameterized flatness error vector,
- using a dynamic controller to calculate optimized actuator set-points in order to minimize the parameterized flatness error, thereby achieving the desired strip flatness.

The method of the present invention creates an improved, stable and robust flatness control system that at any given time uses the optimal combinations of the available actuators.

The method will also reduce the control problem to a problem with fewer control loops but at the same time use all actuators simultaneously. The number of control loops are determined by the number of significant flatness effects that different combinations of actuators may produce. The number of significant effects is in turn deduced from the distribution of singular values of the mill matrix Furthermore the invention will enable the operators to fully use automatic mode, which will enhance the output of the mill in terms of less scrap produced and higher rolling speed keeping the same quality.

BRIEF DESCRIPTION OF THE DRAWINGS

For better understanding of the present invention, reference will be made to the below drawings/figures.

DESCRIPTION OF PREFERRED EMBODIMENT

Figure 1:
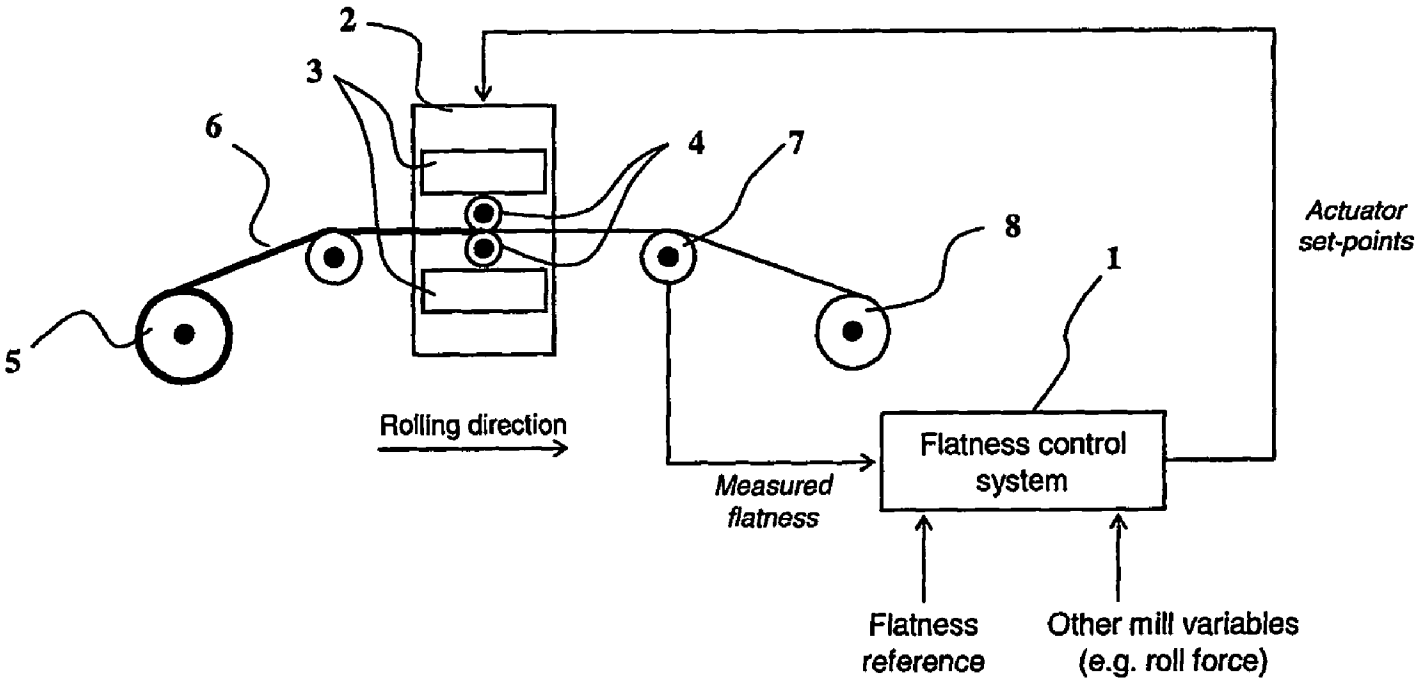
FIG. 1 illustrates an outline of a rolling mill with one mill stand where the available control devices, actuators, are situated, a flatness measurement device, and the flatness control system that computes the set points to the actuators.

As disclosed in FIG. 1 a flatness control system 1 is integrated in a system comprising a mill stand 2 having several actuators 3 and rolls 4. An uncoiler 5 feeds a strip 6 to and through the mill stand 2 whereby the strip 6 passes a flatness measurement device 7 or tension detecting means, for example a "Stressometer", and rolled up on a coiler 8. The mill stand may control skewing, bending and/or shifting of the rolls 4. The resulting product of the rolling process is a rolled strip 6 with a desired flatness.

Figure 2:
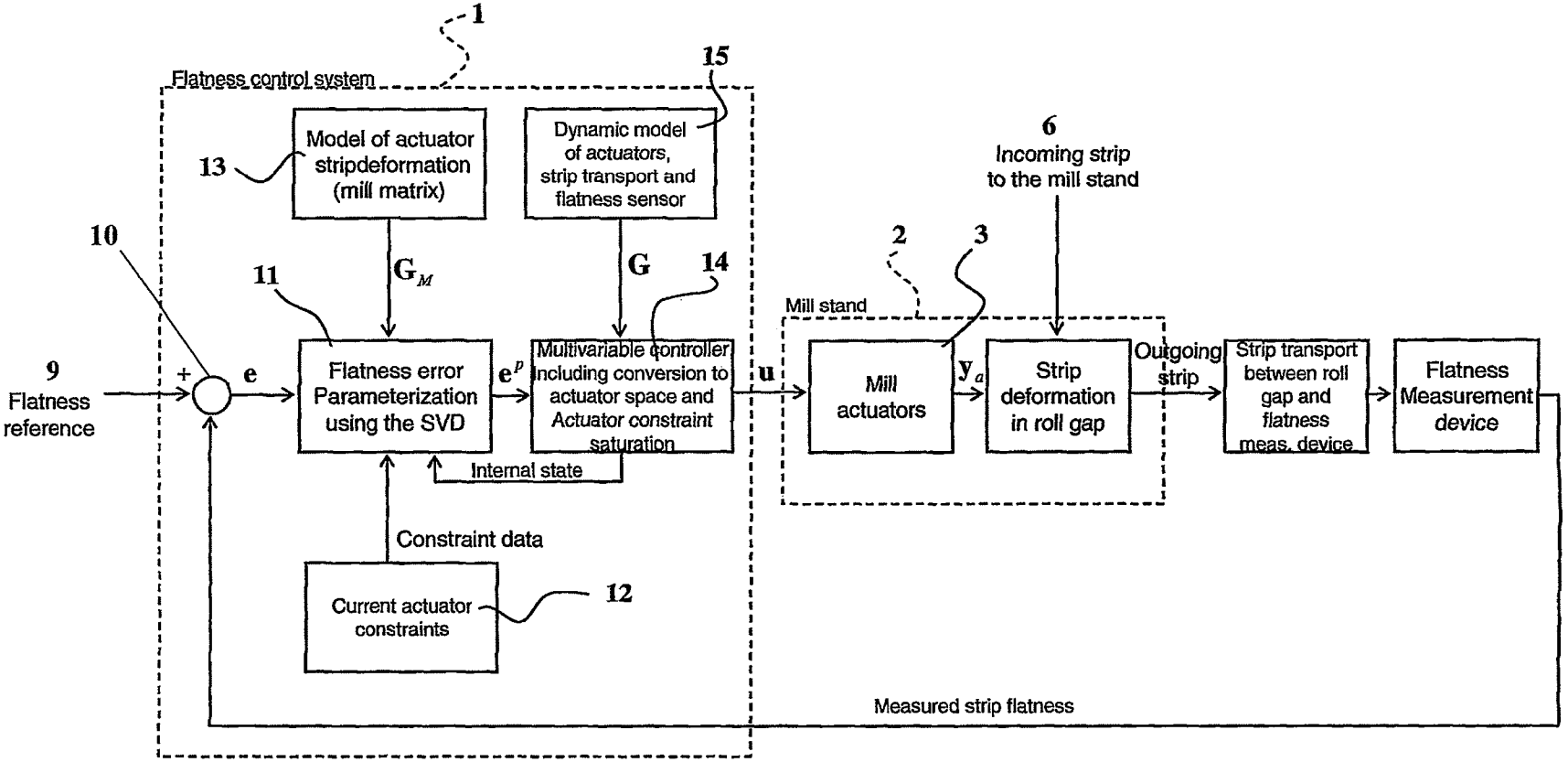
FIG. 2 illustrates the control architecture of the present invention and its relation to the other components in the rolling mill.

The flatness control system 1 is designed around a number of advanced building blocks, as can be seen in FIG. 2, having all required functionalities.

A flatness reference 9 is compared to the measured strip flatness in a comparator 10. The resulting flatness error e, is fed to a flatness error parameterization unit 11 that is also fed with signals from a first unit 12 representing current actuator constraints and signals from a second unit 13 representing a model of the actuator strip information, the mill matrix $G_M$. The resulting parameterized flatness error vector $e^p$ is fed to a multivariable/dynamic controller 14 that converts the information to actuator space and actuator constraint saturation. A dynamic model G of the actuators strip transport and flatness sensor is, at the same time, fed to the multivariable controller 14 from a third unit 15. The resulting coordinate system u is fed to the mill stand 2 and the actuators 3.

Different rolling conditions may require different controlling strategies and compensations have to be handled depending on the rolled strip, e.g. its width, thickness and material. Important is to handle the physical constraints that all actuators have. These can be stroke, min/max, slew-rate limits (speed) and relative stroke limits e.g. step limits in cluster mills. All these constraints may also be varying.

Figure 3:
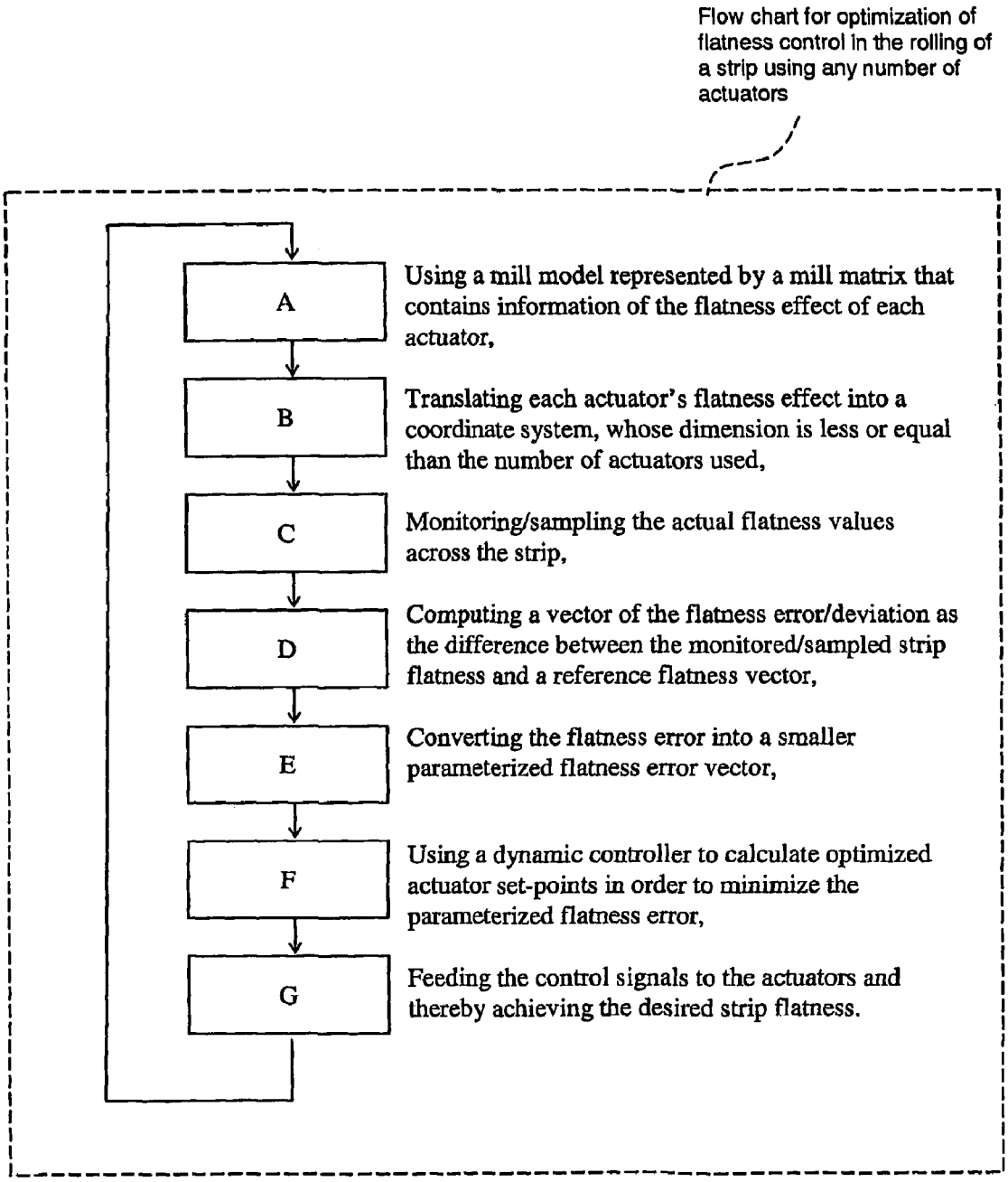
FIG. 3 illustrates a basic flow chart for the different method steps in the present flatness control system.

FIG. 3 discloses a flow chart of the functions of the flatness control system. The method comprises:

A. using a mill model represented by a mill matrix that contains information of the flatness effect of each actuator, B. translating each actuator's flatness effect into a coordinate system, whose dimension is less or equal than the number of actuators used, C. monitoring/sampling the actual flatness values across the strip, D. computing a vector of the flatness error/deviation as the difference between the monitored/sampled strip flatness and a reference flatness vector, E. converting the flatness error into a smaller parameterized flatness error vector, F. using a dynamic controller to calculate optimized actuator set-points in order to minimize the parameterized flatness error, G. feeding the control signals to the actuators and thereby achieving the desired strip flatness.

The present invention uses an advanced flatness error parameterization method for handling the different actuator constraints. Existing methods in literature that relies on the basic flatness control system structure: a flatness error parameterization step followed by a dynamic controller, does not explicitly take actuator constraints into account in the flatness error parameterization step.

The present invention solves this problem by making the flatness error parameterization in such a way that no actuator constraints are violated. This feature is crucial in order to get the most out of the actuator available for flatness control.

In practice different actuators may at any time be put into auto or manual mode, hence the flatness control system must be able to cope with such situations. The present invention does explicitly take mode handling directly into account in the parameterization step.

This invention solves this problem by doing the flatness error parameterization in such a way so that the flatness control is optimal even if one or more actuators are put into manual mode and cannot be used by the flatness control.

The invention solves the flatness control problem using the following assumptions:

1. The control system may be event driven. i.e. flatness samples is arriving in an event based manner or cyclically driven i.e. flatness samples is arriving in a cyclic manner.
2. The flatness error parameterization can be any type of a linear projection. Hence any parameterization matrix $G_p$ is allowed, where the Singular Value Decomposition, SVD, may be used to obtain one type of such a matrix.
3. The dynamic controller may be any type of a discrete-time linear controller with a direct term. Any such controller can be written in state-space form:

$$x_c(k+1)=A(k)x_c(k)+B(k)y_c(k)$$

$$u(k)=C(k)x_c(k)+D(k)y_c(k)$$

where:

$x_c(k)$ is the internal controller state vector, $y_c(k)$ is the controller input vector, which may be a concatenation of the parameterized flatness error $e^p$ and any other mill variables, and A(k), B(k), C(k), D(k) are controller matrices that may vary from sample. This is necessary in order to cope with changing system dynamics, such as varying actuator dynamics and strip transport delay between the roll gap and the flatness measurement device.

The following two steps are carried out at every new flatness sample y(k):

1. Flatness error parameterization using any parameterization matrix $G_p$ and a constrained least squares method to compute the flatness error parameters $e^p$ so that no actuator limits are violated, and
2. The dynamic controller is executed with the computed $e^p$ in order to get the control signals u to be applied to the mechanical actuators.

The most important features of the invention are construction of the parameterization matrix $G_p$ and the related mapping from controller outputs to actuator inputs in case of the SVD based flatness error parameterization is used and formulation of a constrained convex optimization problem that is able to compute the parameterized flatness error $e^p$ in real-time so that no actuator constraints are violated.

The present invention makes a constrained optimization formulation of the flatness error parameterization problem. Given the following discrete-time multivariable controller $$x_c(k+1) = A(k)x_c(k) + B(k)y_c(k)$$

$$u(k) = C(k)x_c(k) + D(k)y_c(k),$$

where $$y_c(k) = \begin{bmatrix} e^p(k) \\ y_m(k) \end{bmatrix}$$

and $y_m(k)$ is any mill process variables, the flatness parameterization problem is, according to the invention, formulated as:

$$\min_{e^p} \|G_p(k)e^p(k) - e(k)\|^2$$

$$\text{such that } C_{ieq}(k)e^p(k) \leqq d_{ieq}(k)$$

$$C_{eq}(k)e^p(k)=0$$

where $C_{ieq}(k)$ and $d_{ieq}(k)$ is constructed, using the controller parameters C(k), D(k) and $x_c(k)$, so that the control signal u(k) does not violate actuator amplitude-, slew-rate and limits. It is also possible to specify relative limits between different actuators. The matrix $C_{eq}(k)$ is constructed so that the amount of parameterized flatness error $e^p(k)$ that goes to actuator i via the direct term D(k) is zero if actuator i should not be used for automatic control.

Below formulation of the parameterization and mapping matrices for SVD based flatness error parameterization is presented. Given a mill matrix $G_M(k)$ and its singular value decomposition $U(k)\cdot\Sigma(k)\cdot V^T(k)$, the parameterization matrix is given by the first $N_p$ columns in U(k) which corresponds to the first $N_P$ diagonal elements in $\Sigma(k)$ that are significantly greater than zero, hence:

$$G_p(k)=U(:,1:N_p).$$

If the dynamic controller is chosen to do its control in the flatness error parameter space, e.g. one PI controller for each flatness error parameter, the outputs from the controller must be mapped to the actuator space. This mapping M is formed as $$M=V(:,1:N_p)(\Sigma(1:N_p,1:N_p))^{-1}.$$

Hence the mapped controller output is given as $$u_m(k)=M(k)u(k)=M(k)C(k)x_c(k)+M(k)D(k)y_c(k).$$

The advantage of the present invention is the general formulation of a convex optimization problem that facilitates the use both simple and advanced flatness error parameterization methods, as long as they can be described by a parameterization matrix $G_p$, together with a linear multivariable controller, in such a way that actuator constraints and mode handling is taken care of.

The invention does at any given time use the optimal combinations of the available actuators. Mathematically it means that an enhanced version of SVD (Singular Value Decomposition) is used for parameterization of the flatness error. The enhancement consists of using the actuator properties in the parameterization. The actuator properties that are considered are e.g. speed, flatness effect and working range.

The invention may be carried out using a computer program including computer program codes. The computer program may be on a computer readable medium.

The invention will reduce the control problem to a problem with fewer control loops but at the same time use all actuators simultaneously. The number of control loops are determined by the number of SVD-values used. It will also enable the operators to fully use automatic mode, which will enhance the output of the mill.

It is noted that while the above describes exemplifying embodiments of the invention, there are several variations and modifications which may be made to the disclosed solution without departing from the scope of the present invention as defined in the appended claims.

The invention claimed is:

1. A method for optimization of flatness control in the rolling of a strip using any number of mill stands and actuators, the method comprising:

using a mill model represented by a mill matrix comprising information of a flatness effect of each actuator, translating the flatness effect of each actuator into a coordinate system having dimension is less or equal than a number of actuators used, monitoring/sampling an actual flatness values across the strip, computing a vector of a flatness error/deviation as a difference between the monitored/sampled strip flatness and a reference flatness vector, converting the flatness error into a smaller parameterized flatness error vector, and using a dynamic controller to calculate optimized actuator set-points in order to minimize the parameterized flatness error, thereby achieving the desired strip flatness.

2. The method according to claim 1, wherein the dynamic controller used is a linear multivariable controller.

3. The method according to claim 1, wherein the parameterized flatness error is computed using different actuator properties.

4. The method according to claim 3, wherein the actuator properties comprise at least one of speed, relative position limits between different actuators, absolute position limits, the actuator flatness effects or other physical constraints of the actuators.

5. The method according to claim 1, wherein the parameterized flatness error is computed using a knowledge of the state and/or parameters of a linear multivariable controller as well as the different actuator properties.

6. The method according to claim 1, further comprising:

using a translation back to an original actuator coordinate system if a multivariable controller produces control signals in a space of another dimension than the number of actuators.

7. The method according to claim 1, wherein Singular Value Decomposition is used when translating the flatness effect of each actuator into the coordinate system.

8. The method according to claim 1, further comprising:

projecting the flatness error to a space spanned by basis vectors of the coordinate system used to describe the flatness effect of the actuators, when converting the flatness error into a smaller parameterized flatness error vector.

9. The method according to claim 1, wherein the parameterized flatness error is computed when working in real time.

10. A system for optimization of flatness control in rolling of a strip using any number of mill stands and actuators, the system comprising:

a mill model represented by a mill matrix comprising information of a flatness effect of each actuator, a translation module configured to translate the flatness effect of each actuator received from the mill model into a coordinate system having dimension is less or equal than the number of actuators used, a flatness measuring device configured to monitor/sample an actual flatness values across the strip, a computing module configured to compute a vector of the flatness error/deviation as a difference between the monitored/sampled strip flatness received from the flatness measuring device and a reference flatness vector, a converting module configured to receive the flatness error and convert the flatness error into a smaller parameterized flatness error vector, and a dynamic controller configured to receive the parameterized flatness value and to calculate optimized actuator set-points in order to minimize the parameterized flatness error, thereby achieving the desired strip flatness.

11. The system according to claim 10, wherein the dynamic controller is a linear multivariable controller.

12. The system according to claim 10, further comprising:

an error computing unit module configured to compute the parameterized flatness error using different actuator properties.

13. The system according to claim 12, wherein the actuator properties comprise at least one of speed, relative position limits between different actuators, absolute position limits, the actuator flatness effects or other physical constraints of the actuators.

14. The system according to claim 10, further comprising:

a parameterized flatness computing module configured to compute the parameterized flatness error using a knowledge of the state and/or parameters of a linear multivariable controller as well as different actuator properties.

15. The system according to claim 10, further comprising:

a translation module configured to translate back to an original actuator coordinate system if a multivariable controller produces control signals in a space of another dimension than the number of actuators.

16. The system according to claim 10, further comprising:

a translation module configured to use Singular Value Decomposition when translating the flatness effect of each actuator into the coordinate system.

17. The system according to claim 10, further comprising:

a flatness error projecting module configured to project the flatness error to a space spanned by basis vectors of the coordinate system used to describe the flatness effect of the actuators, when converting the flatness error into a smaller parameterized flatness error vector.

18. The system according to claim 10, further comprising:

a computing module configured to work in real time when computing the parameterized flatness error.

19. A computer program product, comprising:

a computer readable medium; and computer program recorded on the computer readable medium and executable by a processor for carrying out a method for optimization of flatness control in the rolling of a strip using any number of mill stands and actuators, the method comprising using a mill model represented by a mill matrix comprising information of a flatness effect of each actuator, translating the flatness effect of each actuator into a coordinate system having dimension is less or equal than a number of actuators used, monitoring/sampling an actual flatness values across the strip, computing a vector of a flatness error/deviation as a difference between the monitored/sampled strip flatness and a reference flatness vector, converting the flatness error into a smaller parameterized flatness error vector, and using a dynamic controller to calculate optimized actuator set-points in order to minimize the parameterized flatness error, thereby achieving the desired strip flatness.

* * * * *